US012263993B2

(12) United States Patent
Blayney et al.

(10) Patent No.: US 12,263,993 B2
(45) Date of Patent: Apr. 1, 2025

(54) REMOVABLE CAP

(71) Applicant: SUSTAINABLE PACKAGING DESIGNS LIMITED, Hexham (GB)

(72) Inventors: Mark Richard Blayney, Northumberland (GB); Jason Ashley Lehman, Brighouse (GB); Michael John Bean, Barnsley (GB)

(73) Assignee: SUSTAINABLE PACKAGING DESIGNS LIMITED, Hexham (GB)

( * ) Notice: Subject to any disclaimer, the term of this patent is extended or adjusted under 35 U.S.C. 154(b) by 0 days.

(21) Appl. No.: 18/779,993

(22) Filed: Jul. 22, 2024

(65) Prior Publication Data

US 2025/0033835 A1 Jan. 30, 2025

(30) Foreign Application Priority Data

Jul. 28, 2023 (GB) ..... 2311662

(51) Int. Cl.
*B65D 41/04* (2006.01)
*B65D 51/20* (2006.01)

(52) U.S. Cl.
CPC ..... *B65D 41/0435* (2013.01); *B65D 51/20* (2013.01); *B65D 2251/0015* (2013.01); *B65D 2251/0093* (2013.01)

(58) Field of Classification Search
CPC ..... B65D 41/0435; B65D 51/20; B65D 2251/0015; B65D 2251/0093
USPC ..... 215/349–351
See application file for complete search history.

(56) References Cited

U.S. PATENT DOCUMENTS 2,387,439 A * 10/1945 Warth ..... B67B 3/2046 53/490
2,646,183 A * 7/1953 Pellett ..... B65D 41/045 428/335
3,786,954 A 1/1974 Shull
3,928,109 A 12/1975 Pollock et al.
6,817,479 B1 * 11/2004 Ferry ..... B65D 41/045 215/354

(Continued)

FOREIGN PATENT DOCUMENTS

FR 2560155 A1 8/1985

OTHER PUBLICATIONS

"Combined Search and Examination Report under Sections 17 and 18(3)" in GB2311662.7, dated Nov. 7, 2023.

(Continued)

*Primary Examiner* — James N Smalley
(74) *Attorney, Agent, or Firm* — William H. Bollman

(57) ABSTRACT

This invention relates to a removable cap which is metallic to facilitate recovery and recycling.
The removable metal cap is for a container, such as tin or jar which may contain supplements or foodstuffs.
The metallic removable cap has a thread for screwing the metal cap onto a threaded opening of a container. A retaining bead is provided on its inner surface and retains a two-piece wad. The two-piece wad is formed from an upper (cap) layer and a lower (container) layer.
When installed the lower layer seals the container and the retaining bead retains the two-piece wad until removal of the metal cap from the container whereupon the upper layer of the wad separates from the lower layer of the wad and is held inside the metal cap by the retaining bead.

13 Claims, 4 Drawing Sheets

(56) References Cited

U.S. PATENT DOCUMENTS

| | | | | |
|---|---|---|---|---|
| 7,780,024 | B1 * | 8/2010 | Marsella | B65D 41/045 215/276 |
| 2003/0196418 | A1 | 10/2003 | O'Brien et al. | |
| 2004/0238477 | A1 * | 12/2004 | Unsworth | B65D 51/18 215/349 |

OTHER PUBLICATIONS

"Combined Search and Examination Report under Sections 17 & 18(3) Continued" in GB2311662.7, dated Nov. 7, 2023.
"Patents Act 1977: Search Report under Section 17" in GB2311662.7, dated Nov. 6, 2023.

* cited by examiner

REMOVABLE CAP

FIELD

This invention relates to a removable cap. More particularly, but not exclusively, the invention relates to a removable metal cap for a container, such as tin or jar.

The removeable cap is typically fitted to seal the container, for example after the container is filled and prior to shipping, and when removed, the removeable cap is used to open and repeatedly reseal the container.

BACKGROUND

There are many different types of synthetic plastic caps with a wide range of uses and applications, particularly in packaging of food and food supplements.

A disadvantage with many of these synthetic plastic caps is that they are not easily recyclable, whereas metal caps tend to be more easily recoverable from consumer waste and because the base material is metal it is recyclable.

There are therefore more sustainable options with metallic caps than with synthetic plastic caps which can be difficult to recover from consumer waste and so they tend to have limited recycling options.

There is a wide range of sustainable metal screw caps and closures that are made from aluminium or tinplate. These tend to be fitted with a variety of liners to enable sealing to glass or synthetic plastic containers to meet customer requirements, relevant packaging legislation and storage requirements.

However, because of the flexibility inherent with plastic materials, there are many varieties of synthetic plastic formed caps which have no direct metal equivalent and brand owners requiring their functionalities therefore have no option currently but to use synthetic plastic caps.

Ideally metal-based options provide the relevant functionality to give brand owners a choice of a more sustainable alternative material.

In the UK and Europe many bespoke food product suppliers, such as instant coffee producers, use containers with screw caps sealed with a two part wad where on opening the lower part of the wad remains sealed to the opening of the container as a tamper evident seal until removed by the consumer and the upper part of the wad separates from the bottom of the wad on opening and is retained in the cap by way of a moulded bead to enable the cap to reseal the container once first opened by the consumer.

This moulded bead can be formed in a synthetic plastic cap by varying the thickness of the cap walls but this is not possible in a metal cap pressed from sheet metal.

An aim of the present invention therefore is to provide a removable metal cap that can be used with the aforementioned containers, such as jars or synthetic plastic containers.

Another aim of the present invention therefore is to provide a removable metal cap that can be used with two-part wads, one part of which is retained in the cap after opening.

Another aim of the present invention therefore is to provide a removable metal cap that can be used with containers which contain granular or powdered foodstuffs, in particular instant coffee.

The aforementioned containers are typically of the type that are filled by suppliers and which are sealed with a tamper evident seal prior to, or during, closure with a cap.

PRIOR ART

U.S. Pat. No. 3,786,954 (Shull) discloses a cap liner for use with a closure cap for sealing a container. The cap liner is cut from a foamed polyethylene sheet material. It provides an extremely tight seal for products, such as fine powdered products, where leakage was often experienced. The foamed liner material has improved dynamic cushioning properties so that a tight seal is maintained at all times including during handling and shipping.

US patent application US 2003/0196418 (O'Brien et al) discloses a one-component seal and wadding system for a screwcap that includes a seal having lower layers forming an induction heating sealable system for attaching the seal to the neck of a container. A seal substrate includes a free tab lying wholly within the circumference of the seal.

Although successful many of the aforementioned types of caps and closure devices did not address the problems of how to recycle these types of caps.

SUMMARY OF THE INVENTION

According to a first aspect of the invention there is provided a metal removable cap which has a thread for screwing the metal cap onto a threaded opening of a container, such as a tin or jar; a retaining bead; and a two-part wad formed from an upper (cap) layer and a bottom (container) layer, when installed the bottom layer seals the container and the retaining bead retains the two-part wad until removal of the metal cap from the container whereupon the upper layer of the two-part wad separates from the bottom layer of the two-part wad, and upper layer of the two-part wad is held inside the metal cap by the retaining bead.

The invention therefore provides a removable metal cap formed from a sheet of metal that incorporates a formed bead to retain the top layer of a two-part wad on opening and removal of the cap from the container. The removable metal cap can be used with the aforementioned containers, such as jars or synthetic plastic containers.

The containers are typically of the type that are filled by suppliers and which have a tamper evident seal fitted, which covers an opening of the container, prior to or during closure with the metal cap.

Delicate, tamper evident seals are typically formed from a thin sheet of tamper evident material which is attached or adhered taught across the container opening after filling. The thin sheet of tamper evident material may have a non-waxed layer, such as a polymer layer, which ensures the contents of the container are kept airtight and so do not spoil.

Different sizes of removable cap are provided which have a threaded portion whose pitch is sized and dimensioned to match a mouth of a specified container, such as a tin or jar.

An advantage is that the removable cap is made from metal, such as tin or aluminium, and so is easier to sort from a waste stream and to recycle.

According to a second aspect of the invention there is provided a method of fitting a removable cap to a filled container comprising the steps of: providing a container, the container having an open end, adding contents to the container, supporting the seal on a two-part wad within a metal cap, placing the metal cap over an open end of the container, the two-part wad includes a seal that is placed over the open end of the container, closing the metal cap on the container and sealing the seal to form a tamper evident layer over the open end of the container.

Ideally sealing is achieved by heat sealing or gluing the seal to form the tamper evident layer over the open end of the container.

In some embodiments of the removable metal cap, the upper layer of the two-part wad comprises a substantially organic material, such as a cardboard or paper-based layer.

In some embodiments of the removable metal cap the bottom layer of the two-part wad comprises a sealing membrane which seals the opening of the container. Ideally the sealing membrane comprises a wax or food safe sealant which is heat or pressure activated to form an adhesive layer. Optionally this heat activated sealant is provided around a periphery of the two-part wad.

Preferably the retaining bead is dimensioned and arranged to retain the upper layer within the metal cap after the metal cap is removed from the container. More preferably the retaining bead has one or more protrusions on an inside surface of the metal cap.

Optionally the retaining bead comprises one or more beads on an inside surface of the metal cap. Alternatively the retaining bead comprises one or more ridges on an inside surface of the metal cap.

The removable metal cap retains the two-part wad; one part may be formed from a polymer or foil, the other may be cardboard.

The metal removable cap may be used with a container formed from glass or formed from a synthetic plastic material.

In use upper or cardboard layer repeatedly re-seals the contents of the container due to its resiliently deformable nature, its sealing properties and the fact that the cardboard layer is dimensioned to be retained within the metal cap. When the cap is screwed onto a container the cardboard layer abuts and presses against the circular rim of the container and is held tightly against it, thereby sealing the container, by metal cap.

The invention also includes a combination of container and metal removable cap.

Embodiments of the invention will now be described, by way of example only, and with reference to the following Figures, in which:

DETAILED DESCRIPTION OF A PREFERRED EMBODIMENTS OF THE INVENTION

Figure 1:
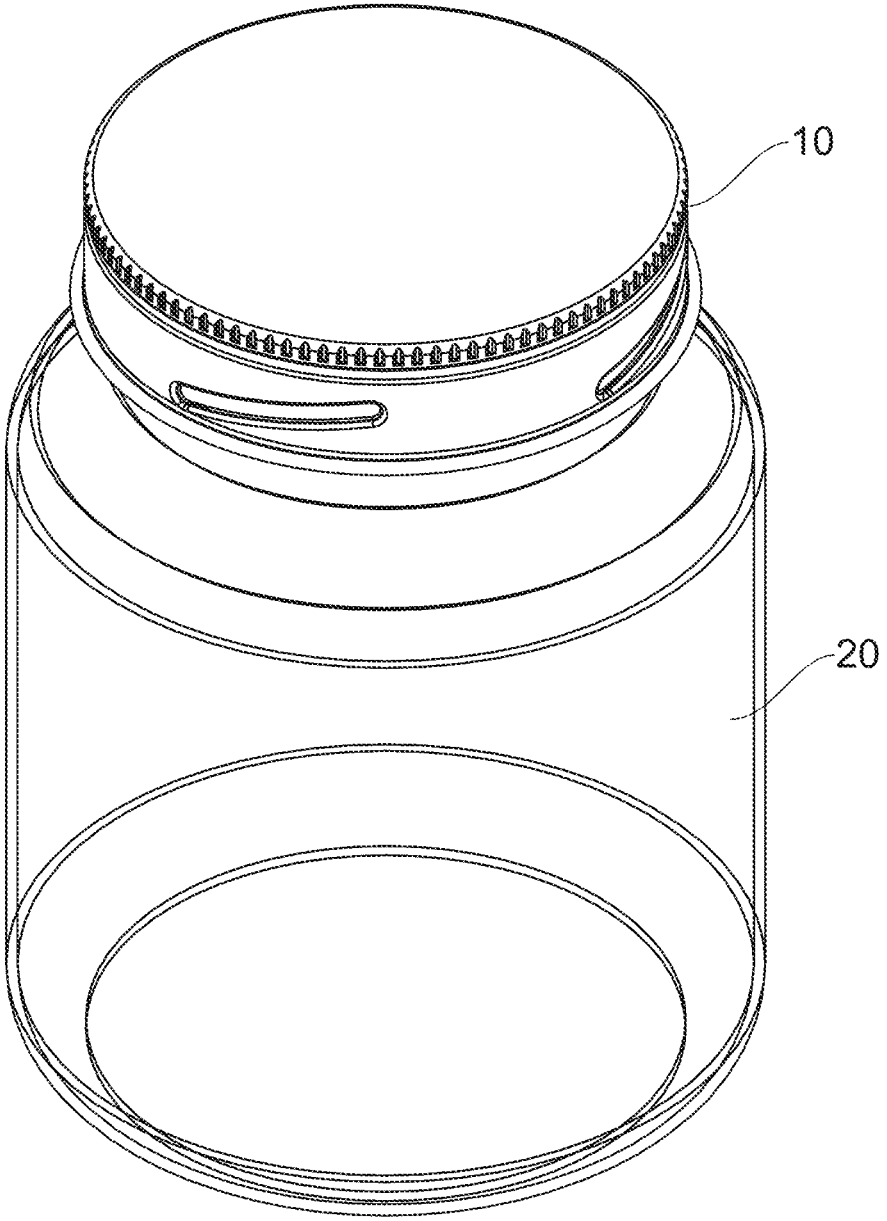
FIG. 1 shows an example of a cap fitted to a jar according to one example of the invention.

FIG. 1 illustrates an example of a finished assembly of a removable metal cap 10 screwed onto a jar 20 by its threaded portion 33 (shown in FIG. 3) after heat sealing has fixed a wax layer 30 (FIG. 3) to the jar.

Figure 2A:
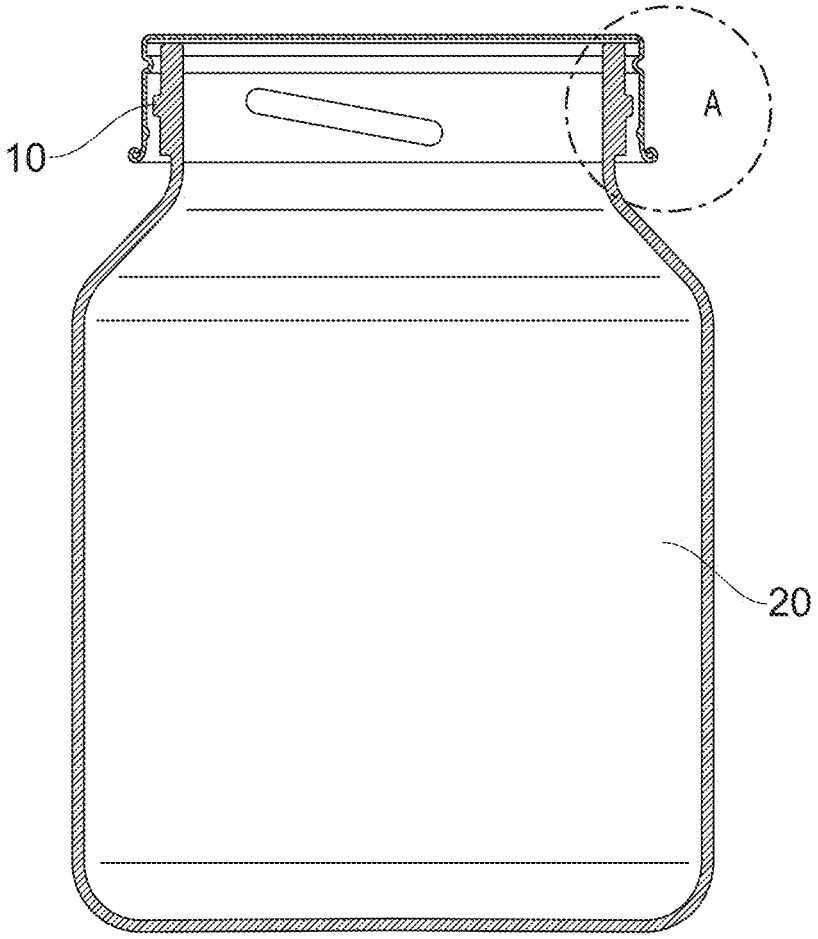
FIG. 2A shows a diagrammatical section of a jar with a metal cap fitted thereto.

Referring to FIG. 2A there is shown a diagrammatical section of the jar 20 with the removable metal cap 10 fitted thereto. The jar 20 is open ended with a circular rim 22 at its open end and has a screw thread for receiving the removable metal cap 10. However, in other examples the rim 22 may take alternative forms.

Figure 2B:
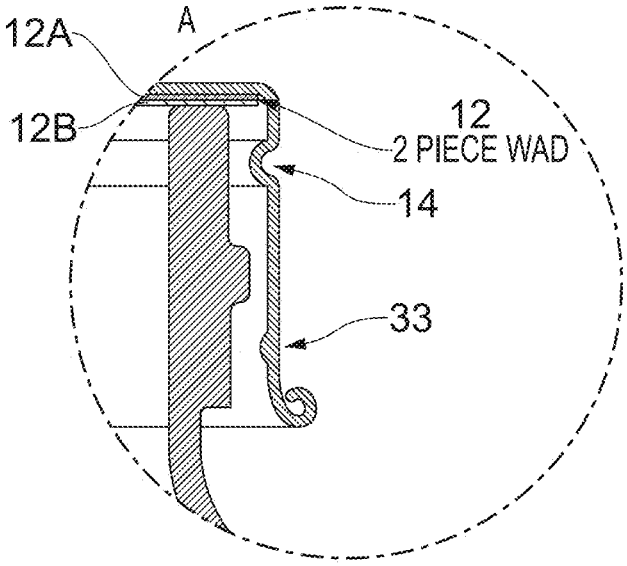
FIG. 2B shows an exploded view of the metal cap and in detail a wad retaining bead in diagrammatical section.
Figure 3A:
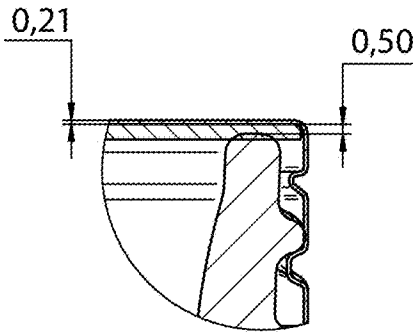
FIGS. 3A to 3D show an overall view of a jar (FIG. 3B) with a heat-sealed layer and a cap (FIG. 3D) removed in readiness for replacement on the jar, FIG. 3A showing enlarged detail of a circled portion in FIG. 3B, and FIG. 3C showing enlarged detail of a circled portion in FIG. 3D.
Figure 3B:
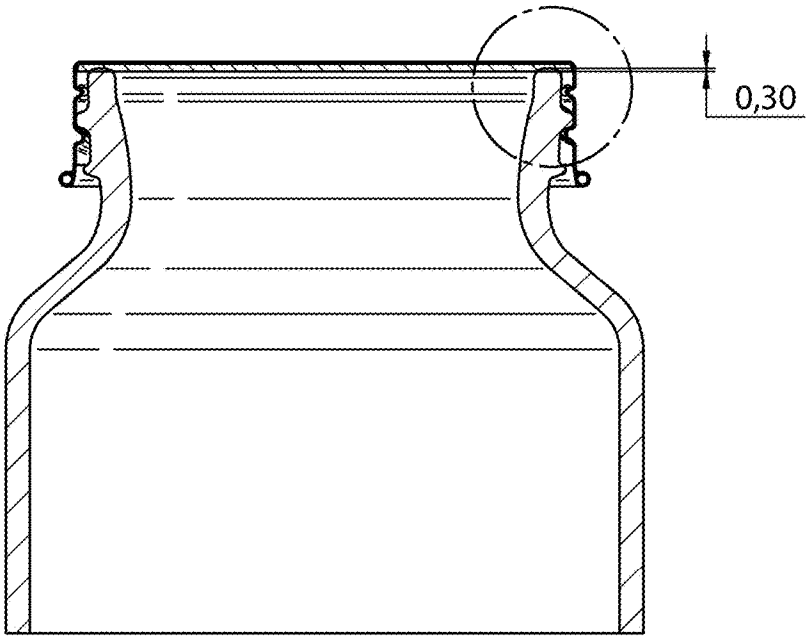
Figure 3C:
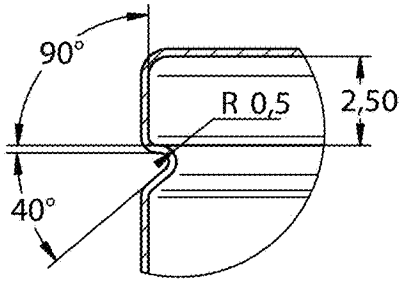
Figure 3D:
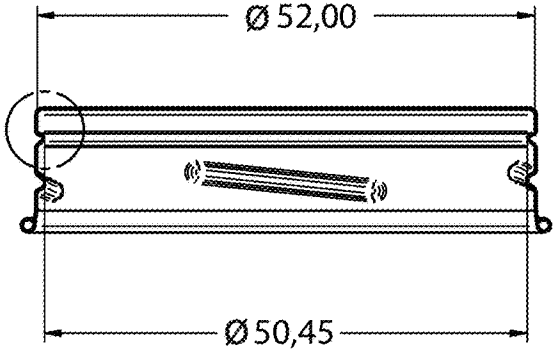

FIG. 2B shows a two-part wad 12 is retained in the removable metal cap 10 by a retaining bead 14. A two-part wad 12 has an upper layer 12A and a lower or bottom layer 12B, described in detail below, and is of a shape which generally conforms to the shape of an open end of the container 20.

The two-part wad 12 preferably comprises two layers, an upper layer 12A and a bottom layer 12B. Bottom layer 12B may typically be formed as metal foil or a polymer foil and is of a suitable diameter to fit around and adhere to the circular rim 22. When the jar 10 is opened the layers 12A and 12B separate the upper layer 12A is retained within an upper part of the metal cap 10 by the bead 14. The bottom layer 12B, and any foil or polymer portion formed thereon, forms a seal, such as a tamper evident seal, 24 which adheres around the circular rim 22 of the container 20 to seal its contents (not shown).

A heat-sealing or gluing process is used to seal the bottom layer 12B of the two-part wad 12 onto the jar 20, after contents, such as coffee granules (not shown) have been added to the jar 20. Specifically, the two-part wad 12 is sealed to the circumference or circular rim 22 of the container or jar 20. Furthermore, the two-part wad 12 can be removed by a consumer so that the contents of the jar 20 can be emptied in one shot for transfer, or to allow access to the jar 20 so that its contents can be removed with a spatula or spoon. For clarity the contents of the jar 20 are not shown in the Figures.

Figure 4:
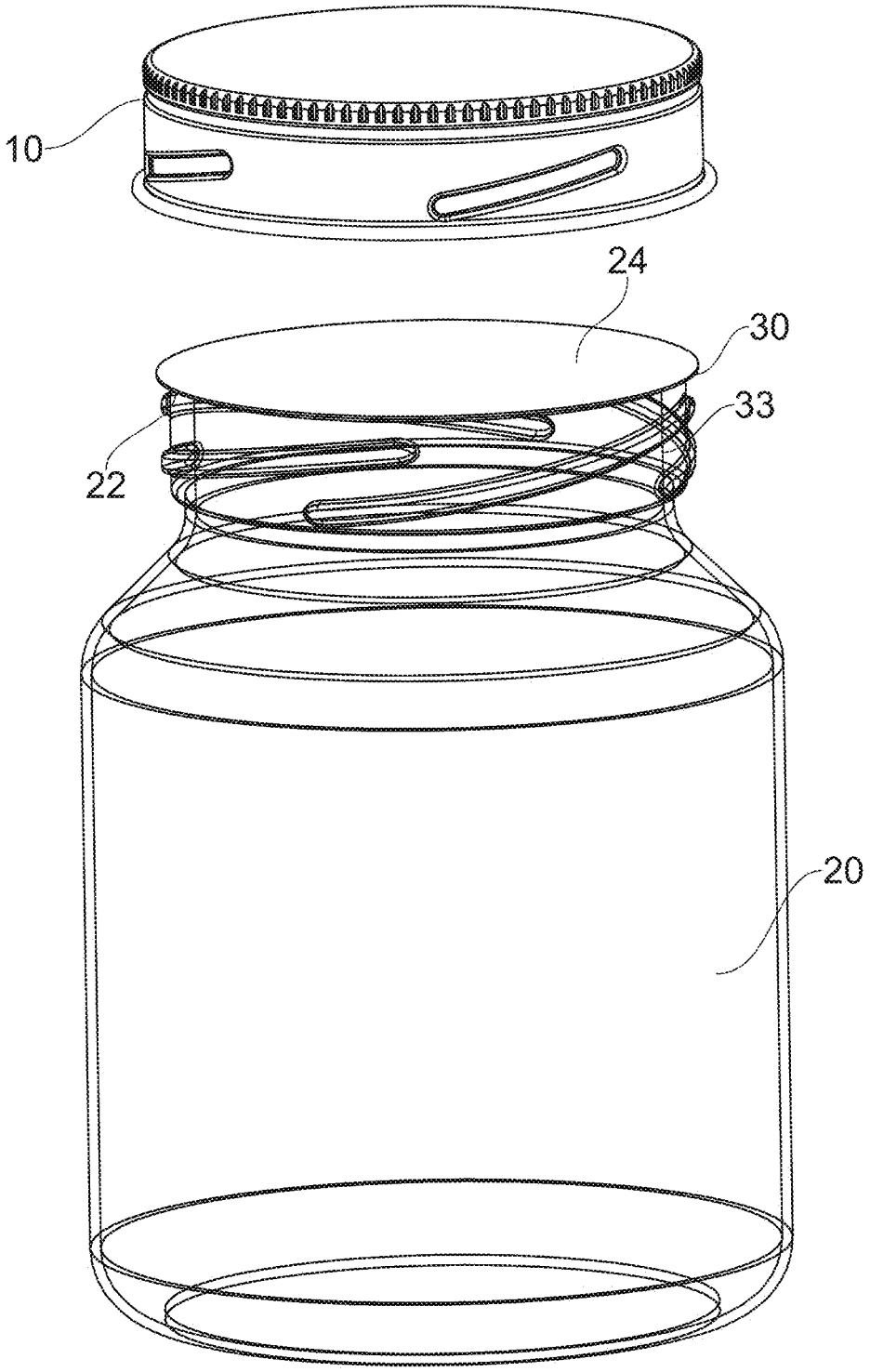
FIG. 4 shows how the removable metal cap and container appear to a consumer when the container is opened for the first time with its tamper evident seal intact.

FIG. 4 shows what is seen when the removable metal cap 10 is first removed by a consumer. The foil part of the bottom layer 12B of the two-part wad 12 separates from the upper cardboard layer 12A, when the metal cap 10 is first unscrewed. The foil part of the bottom layer 12B is shown sealed to an upper mouth of the jar 20. The cardboard layer 12A of the two-part wad 12 snaps or tears and is retained behind the retaining bead 14 within the removable metal cap 10. FIG. 4 therefore shows how tamper evident seal 24 covers the container 20 and protects its contents. The tamper evident seal 24 of the two-part wad 12 is heat sealed (to the jar 20 with its contents inside) soon after filling of the jar 20.

It will be appreciated that the metal cap 10 may be supplied with the two-part wad 12 in situ or the two-part wad 12 may be inserted or fitted to, or forced into, the removable metal cap 10 prior to sealing the jar or container 20.

The removable metal cap 10 may be placed on the jar such that the removable metal cap 10 and seal 24 and are pulled down or compressed onto the top face of the container 20. This process may be performed with a liner fitted to the removable metal cap 10 prior to the heat sealing.

It will be appreciated that in the embodiments described above that one advantage of the invention is that no modification of any existing manufacturing processes or equipment or filling processes is needed.

The removable metal cap 10 may be press fitted to the jar 20 or it may be screwed onto the jar 20 which is rotatably fitted with a corresponding external thread 33 on a top portion of the container.

The metal cap 10 includes means to retain the upper wad layer within the metal cap after the metal cap is removed. The means to retains comprises one or more protrusions or retaining beads 14. It will be appreciated that the retaining bead 14 may consist of ridges or pips on an inside wall of the metal cap. FIG. 2B shows in section and in greater detail, the two-part wad retaining bead(s)/protrusions 14.

Alternatively, an internal ridge/shelf may be provided for this purpose-which may be circular or part circular in form. This is effectively a circumferential ridge which allows retention of the cardboard upper later of the two-part wad within the metal cap when the metal cap is removed. So, the metal cap includes means to retain the upper wad layer 12A which remains therewithin, even after the metal cap 10 is removed; this may be via one or more protrusions, beads or ridges 14 on an inside wall of the metal cap. In other embodiments an adhesive may applied to the inside surface of the removable metal cap 10 to retain the upper lay when opened.

Referring to FIGS. 3A to 3D, the retaining bead 14 in FIG. 2B and in particular the item bead profile shown in the exploded view. In the embodiment shown the distance between the top of the retaining bead 14 and an underside of the top of the cap is 2.5 mm and this is typically subject to a tolerance of ±20%. Ideally the bead profile has a 'flat' top when orientated with respect to an inside surface of the top of the removable cap 10 and a fixed radius (r) with a sloping profile (α), where a is typically 40°. Again, the tolerance to the radius (r) and sloping profile (α) are both subject to a tolerance of ±20%.

FIG. 4 shows how the removable metal cap assembly appears to a consumer when the container is opened for the first time. The lower foil layer or bottom layer 12B of the two-part wad stays sealed to the jar. The cardboard upper layer snaps off or is separated from the foil layer and is retained behind the retaining bead formed in the metal cap. FIG. 4 shows that after removal of the cap 10, and prior to first time access to the contents of the container 20, the lower or foil part of the bottom layer 12B of the two-part wad 12 acts as a tamper evident seal 30 and, after it is removed, the upper or cardboard layer 12A of the two-part wad 12 snaps or tears and is retained behind the retaining bead 14 within the removable metal cap 10. Subsequently, upper or cardboard layer 12A repeatedly re-seals the contents of the container 20 due to its resiliently deformable nature, its sealing properties and the fact that the cardboard layer 12A is dimensioned to abut and press against the circular rim 22 of the container 20 and is held tightly against it by metal cap 10.

The term "size" unless indicated otherwise should be interpreted as area such as of an opening. The term "sealed" in relation to the wad being sealed to the container or receptacle, unless otherwise indicated, should be understood as forming a seal at, or with, the circumference of the open end of the container.

It is appreciated that variation may be made to the aforementioned embodiments, without departing from the scope of the invention, as defined by the claims.

LIST OF PARTS

10 metal cap
12 two-part wad
12A upper (or cardboard) layer
12B bottom (or foil, synthetic plastic film or wax) layer
14 beads or protrusions
20 container or jar
22 circular rim
24 tamper evident foil or wax paper seal
30 heat sealing wax layer
33 external thread

The invention claimed is:

1. A metal removable cap comprising:
a thread for screwing the metal removable cap onto a threaded opening of a container;
a continuous ring forming a retaining bead within the metal removable cap, the continuous ring being separate from the thread; and
a two-part wad comprising an upper cap layer and a bottom container layer, wherein
when installed the bottom container layer seals the container,
the retaining bead retains the two-part wad until removal of the metal removable cap from the container whereupon the upper cap layer of the two-part wad separates from the bottom container layer of the two-part wad,
the bottom container layer being releasable by the continuous ring with the upper cap layer of the two-part wad being held inside the metal removable cap and continuing to be retained by the retaining bead, and
the continuous ring protrudes farther into the metal removable cap than the thread.

2. The metal removable cap according to claim 1, wherein the threaded portion has a pitch to match a mouth of the container.

3. The metal removable cap as according to claim 1, wherein the upper cap layer comprises a substantially paper-based organic material.

4. The metal removable cap according to claim 1, wherein the bottom container layer comprises a sealing membrane which seals the opening of the container.

5. The metal removable cap according to claim 4, wherein the sealing membrane comprises a wax layer.

6. The metal removable cap according to claim 1, wherein the retaining bead is dimensioned and arranged to retain the upper cap layer within the metal cap after the metal cap is removed from the container.

7. The metal removable cap according to claim 1, wherein the retaining bead comprises one or more protrusions formed on an inside surface of the metal cap.

8. The metal removable cap according to claim 1, wherein the retaining bead comprises one or more pips on an inside surface of the metal cap.

9. The metal removable cap according to claim 1, wherein the retaining bead comprises one or more ridges on an inside surface of the metal cap.

10. The metal removable cap according to claim 1, wherein the two-part wad further comprises a metallic or polymer wad.

11. A combination of a container, and the metal removable cap according to claim 1 fitted to the container which is formed from glass.

12. A combination of a container, and the metal removable cap according to claim 1 fitted to the container which is formed from a synthetic plastic material.

13. A method of fitting a metal removable cap to a filled container comprising the steps of:
providing a container having an open end;
adding contents to the container;
providing a two-part wad with a seal on a bottom container layer and an upper cap layer within the metal removable cap, the two-part wad being retained in the metal removable cap by a continuous ring forming a retaining bead separate from a thread of the metal removable cap;
placing the metal removable cap over the open end of the container;
closing the metal removable cap on the container; and heat sealing the seal to form a tamper evident layer over the open end of the container, wherein the bottom container layer is releasable by the continuous ring upon opening the metal removable cap with the upper cap layer of the two-part wad being held inside the metal removable cap and continuing to be retained by the retaining bead, and the continuous ring protrudes farther into the metal removable cap than the thread.

* * * * *